US011878775B2

(12) United States Patent
Montague et al.

(10) Patent No.: US 11,878,775 B2
(45) Date of Patent: Jan. 23, 2024

(54) LEASH SYSTEM AND METHODS OF USE

(71) Applicant: Kai Concepts, LLC, Alameda, CA (US)

(72) Inventors: Donald Lewis Montague, Paia, HI (US); Merten Stroetzel, Pacific Palisades, CA (US); Joseph Andrew Brock, Alameda, CA (US); Alec Korver, Monument, CO (US)

(73) Assignee: Kai Concepts, LLC, Alameda, CA (US)

( * ) Notice: Subject to any disclaimer, the term of this patent is extended or adjusted under 35 U.S.C. 154(b) by 344 days.

(21) Appl. No.: 17/374,218

(22) Filed: Jul. 13, 2021

(65) Prior Publication Data

US 2023/0018353 A1 Jan. 19, 2023

(51) Int. Cl.
*B63B 32/73* (2020.01)
*B63B 79/40* (2020.01)

(52) U.S. Cl.
CPC ..... *B63B 32/73* (2020.02); *B63B 79/40* (2020.01); *B63B 2205/00* (2013.01)

(58) Field of Classification Search
CPC ..... B63B 32/73; B63B 79/40; B63B 2205/00
See application file for complete search history.

(56) References Cited

U.S. PATENT DOCUMENTS 3,317,936 A * 5/1967 Johnson ..... B63C 9/26 242/379.2
3,405,677 A 10/1968 Smith
3,593,050 A 7/1971 Ware
3,704,442 A 11/1972 Wright
(Continued)

FOREIGN PATENT DOCUMENTS

AU 5012101 A 12/2002
AU 200150121 12/2002
(Continued)

OTHER PUBLICATIONS

"Battery disconnect killswitch for motorized kayak" (Waterblade LLC) Apr. 12, 2020 [online] retrieved from <URL: https://www.youtube.com/watch?v=mpwgZfyBovA> entire document, especially demonstration 0:06-1:34.
(Continued)

*Primary Examiner* — Stephen P Avila
(74) *Attorney, Agent, or Firm* — Fitch, Even, Tabin & Flannery LLP

(57) ABSTRACT

A leash system and methods of use are provided that includes a leash cord configured to be affixed at a first end portion to a user of a personal watercraft, a switch cord, and an anchoring cord. The switch cord has a first end portion affixed to a key for connection to a kill switch of the watercraft and a second end portion affixed to the leash cord. The anchoring cord has a first end portion configured to fixedly secure the anchoring cord to the watercraft and a second end portion affixed to the leash cord. A loop is affixed in preferred examples along the anchoring cord that is configured to slidably receive the switch cord therethrough. When the leash cord is pulled taut while the anchoring cord is fixedly secured to the watercraft, the first end portion of the switch cord is drawn toward the loop to remove the key.

22 Claims, 7 Drawing Sheets

(56) References Cited

U.S. PATENT DOCUMENTS

| | | | |
|---|---|---|---|
| 3,886,884 | A | 6/1975 | Stark et al. |
| 3,902,444 | A | 9/1975 | Stark |
| 4,056,074 | A | 11/1977 | Sachs |
| 4,517,912 | A | 5/1985 | Jones |
| 4,567,961 | A | 2/1986 | Schoenfeld |
| 5,062,378 | A | 11/1991 | Bateman |
| 5,178,089 | A | 1/1993 | Hodel |
| 5,309,859 | A | 5/1994 | Miller |
| 5,809,926 | A | 9/1998 | Kelsey |
| 5,848,922 | A | 12/1998 | Itima et al. |
| 6,095,076 | A | 8/2000 | Nesbitt |
| 6,142,840 | A | 11/2000 | Efthymiou |
| 6,178,905 | B1 | 1/2001 | Dynes et al. |
| 6,183,333 | B1 | 2/2001 | Hall |
| 6,192,817 | B1 | 2/2001 | Dec et al. |
| 6,311,631 | B1 | 11/2001 | Beecher |
| 6,371,726 | B1 | 4/2002 | Jonsson et al. |
| 6,409,560 | B1 | 6/2002 | Austin |
| 6,475,045 | B2 | 11/2002 | Schultz et al. |
| 6,568,340 | B2 | 5/2003 | Dec et al. |
| 6,578,506 | B2 | 6/2003 | Bieker |
| 6,591,776 | B2 | 7/2003 | Miyazaki |
| 6,702,634 | B2 | 3/2004 | Jung |
| 6,743,064 | B2 | 6/2004 | Gieseke |
| 6,855,016 | B1 | 2/2005 | Jansen |
| 6,902,446 | B1 | 6/2005 | Healey |
| 6,966,808 | B1 | 11/2005 | Liao |
| 7,047,901 | B2 | 5/2006 | Chen |
| 7,089,875 | B2 | 8/2006 | Kurze |
| 7,097,523 | B2 | 8/2006 | Woolley |
| 7,138,774 | B2 | 11/2006 | Negoro et al. |
| 7,143,710 | B2 | 12/2006 | Lang et al. |
| 7,166,005 | B2 | 1/2007 | Tirloni et al. |
| 7,182,036 | B2 | 2/2007 | Levine |
| 7,182,037 | B2 | 2/2007 | Otobe et al. |
| 7,226,329 | B2 | 6/2007 | Railey |
| 7,243,607 | B2 | 7/2007 | Chesney et al. |
| 7,275,493 | B1 | 10/2007 | Brass |
| 7,298,056 | B2 | 11/2007 | Gizara |
| 7,506,600 | B2 | 3/2009 | Furuya et al. |
| 7,601,041 | B2 | 10/2009 | McCarthy |
| 7,731,555 | B2 | 6/2010 | Railey |
| 7,980,191 | B2 | 7/2011 | Murphy |
| 7,993,178 | B2 | 8/2011 | Railey |
| 8,043,135 | B1 | 10/2011 | Corn |
| 8,070,544 | B2 | 12/2011 | Roman |
| 8,123,578 | B2 | 2/2012 | Mewis |
| 8,166,905 | B2 | 5/2012 | Gratsch |
| 8,290,636 | B2 | 10/2012 | Manning |
| 8,312,831 | B2 | 11/2012 | Templeman et al. |
| 8,398,446 | B2 | 3/2013 | Railey et al. |
| 8,456,310 | B2 | 6/2013 | Becker |
| 8,636,552 | B2 | 1/2014 | Braden et al. |
| 8,702,458 | B2 | 4/2014 | Preston |
| 8,851,947 | B2 | 10/2014 | Vlock et al. |
| 8,863,681 | B2 | 10/2014 | Howes et al. |
| 8,870,614 | B2 | 10/2014 | Railey |
| 8,951,079 | B2 | 2/2015 | Railey et al. |
| 9,051,038 | B1 | 6/2015 | Herber |
| 9,056,654 | B1 | 6/2015 | Fraser |
| 9,120,547 | B2 | 9/2015 | Vlock et al. |
| 9,162,741 | B2 | 10/2015 | Kohnsen |
| 9,359,044 | B2 | 6/2016 | Angelaan |
| 9,475,559 | B2 | 10/2016 | Czarnowski et al. |
| 9,573,656 | B2 | 2/2017 | Templeman |
| 9,586,659 | B2 | 3/2017 | Langelaan |
| 9,643,694 | B2 | 5/2017 | Geislinger et al. |
| 9,669,902 | B2 | 6/2017 | Geislinger |
| 9,701,372 | B2 | 7/2017 | Railey |
| 9,718,521 | B2 | 8/2017 | Derrah |
| 9,718,528 | B2 | 8/2017 | Railey et al. |
| 9,758,962 | B2 | 9/2017 | Geislinger et al. |
| 9,789,935 | B1 | 10/2017 | Aguera |
| 9,789,943 | B2 | 10/2017 | Lehmann |
| 9,835,224 | B2 | 12/2017 | Geislinger et al. |
| 9,845,138 | B2 | 12/2017 | Kohnsen |
| 10,029,775 | B2 | 7/2018 | Nikmanesh |
| 10,099,754 | B2 | 10/2018 | Tian |
| D843,303 | S | 3/2019 | Eason et al. |
| 10,227,120 | B2 | 3/2019 | Ajello |
| 10,235,870 | B2 | 3/2019 | Leason et al. |
| 10,266,239 | B2 | 4/2019 | Fry |
| 10,279,873 | B2 | 5/2019 | Logosz |
| D852,112 | S | 6/2019 | Eason et al. |
| 10,308,336 | B1 | 6/2019 | Vermeulen |
| D853,310 | S | 7/2019 | Eason et al. |
| 10,358,194 | B1 | 7/2019 | Wengreen et al. |
| D857,606 | S | 8/2019 | Dane |
| D866,872 | S | 11/2019 | Liu |
| 10,486,771 | B2 | 11/2019 | Tian |
| 10,526,057 | B2 | 1/2020 | Kohnsen |
| 10,532,797 | B2 | 1/2020 | Derrah |
| 10,597,118 | B2 | 3/2020 | Montague et al. |
| 10,597,123 | B2 | 3/2020 | Bell |
| D882,010 | S | 4/2020 | Vermillion |
| 10,618,621 | B1 | 4/2020 | Rott et al. |
| 10,625,834 | B2 | 4/2020 | MacFarlane |
| D883,177 | S | 5/2020 | Leason et al. |
| 10,647,387 | B2 | 5/2020 | Dombois |
| 10,647,392 | B2 | 5/2020 | Trewern |
| 10,668,987 | B1 | 6/2020 | Murphy |
| 10,668,994 | B2 | 6/2020 | Frank |
| 10,683,075 | B2 | 6/2020 | Schibli |
| 10,759,503 | B2 | 9/2020 | Aguera |
| 10,946,939 | B1 | 3/2021 | Montague et al. |
| 2001/0042498 | A1 | 11/2001 | Burnham |
| 2002/0072285 | A1 | 6/2002 | Jung |
| 2003/0089293 | A1 | 5/2003 | Vos |
| 2003/0167991 | A1 | 9/2003 | Namanny |
| 2004/0139905 | A1 | 7/2004 | Chen |
| 2005/0266746 | A1 | 12/2005 | Murphy |
| 2006/0249513 | A1 | 11/2006 | Duke |
| 2008/0041294 | A1 | 2/2008 | Diorio et al. |
| 2008/0168937 | A1 | 7/2008 | Ruan et al. |
| 2008/0243321 | A1 | 10/2008 | Walser et al. |
| 2008/0268730 | A1 | 10/2008 | Heesterman |
| 2011/0056423 | A1 | 3/2011 | Railey |
| 2011/0201238 | A1 | 8/2011 | Rott et al. |
| 2011/0256518 | A1 | 10/2011 | Rott |
| 2012/0000409 | A1 | 1/2012 | Railey |
| 2012/0126972 | A1 | 5/2012 | Rott et al. |
| 2013/0029547 | A1 | 1/2013 | Suzuki |
| 2013/0157526 | A1 | 6/2013 | Martin |
| 2014/0053764 | A1 | 2/2014 | Ruan et al. |
| 2015/0064995 | A1 | 3/2015 | Woods et al. |
| 2015/0104985 | A1 | 4/2015 | Langelaan |
| 2015/0118923 | A1 | 4/2015 | Kohnsen |
| 2016/0185430 | A1 | 6/2016 | Langelaan |
| 2016/0207601 | A1 | 7/2016 | Kohnsen |
| 2017/0043844 | A1 | 2/2017 | Chapman |
| 2017/0221657 | A1 | 8/2017 | Barker |
| 2018/0099730 | A1 | 4/2018 | Riegerbauer |
| 2018/0118311 | A1 | 5/2018 | Kohnsen |
| 2018/0370600 | A1 | 12/2018 | Geislinger |
| 2019/0061557 | A1 | 2/2019 | Quick et al. |
| 2019/0061880 | A1 | 2/2019 | Bousquet |
| 2019/0161148 | A1 | 5/2019 | Trewern |
| 2019/0168851 | A1 | 6/2019 | Tian |
| 2019/0233063 | A1 | 8/2019 | Geislinger |
| 2019/0233076 | A1 | 8/2019 | Aldama |
| 2019/0344862 | A1 | 11/2019 | Tian |
| 2019/0389551 | A1 | 12/2019 | Aoki et al. |
| 2020/0018969 | A1 | 1/2020 | Ou et al. |
| 2020/0047849 | A1 | 2/2020 | Claughton et al. |
| 2020/0079479 | A1 | 3/2020 | Derrah |
| 2020/0102052 | A1 | 4/2020 | Geislinger et al. |
| 2020/0140042 | A1 | 5/2020 | Kohnsen |
| 2020/0172206 | A1 | 6/2020 | Terada |
| 2020/0172207 | A1 | 6/2020 | Wengreen et al. |
| 2020/0172213 | A1 | 6/2020 | Rodriguez Rondon et al. |
| 2020/0231264 | A1 | 7/2020 | Imai |
| 2020/0283102 | A1 | 9/2020 | Lind et al. |

(56) References Cited

U.S. PATENT DOCUMENTS

| | | | |
|---|---|---|---|
| 2020/0398938 | A1 | 12/2020 | Montague |
| 2021/0139114 | A1 | 5/2021 | Lee |

FOREIGN PATENT DOCUMENTS

| | | | |
|---|---|---|---|
| AU | 2004100571 | A4 | 8/2004 |
| AU | 2007100530 | A4 | 9/2007 |
| AU | 2007202855 | A1 | 1/2009 |
| AU | 2013100044 | A4 | 2/2013 |
| AU | 2018390893 | A1 | 7/2020 |
| BR | 102013022366 | A2 | 8/2015 |
| CN | 2675546 | Y | 2/2005 |
| CN | 2875944 | Y | 3/2007 |
| CN | 101012003 | A | 8/2007 |
| CN | 201012743 | Y | 1/2008 |
| CN | 201012744 | Y | 1/2008 |
| CN | 201023637 | Y | 2/2008 |
| CN | 201086813 | Y | 7/2008 |
| CN | 201220740 | Y | 4/2009 |
| CN | 201291996 | Y | 8/2009 |
| CN | 201300970 | Y | 9/2009 |
| CN | 201300971 | Y | 9/2009 |
| CN | 201329950 | Y | 10/2009 |
| CN | 201331716 | Y | 10/2009 |
| CN | 201347194 | Y | 11/2009 |
| CN | 201390374 | Y | 1/2010 |
| CN | 201406017 | Y | 2/2010 |
| CN | 201406019 | Y | 2/2010 |
| CN | 201406020 | Y | 2/2010 |
| CN | 201407093 | Y | 2/2010 |
| CN | 201407094 | Y | 2/2010 |
| CN | 201415754 | Y | 3/2010 |
| CN | 201437400 | U | 4/2010 |
| CN | 201447051 | U | 5/2010 |
| CN | 101734354 | A | 6/2010 |
| CN | 101734355 | A | 6/2010 |
| CN | 101734356 | A | 6/2010 |
| CN | 101746490 | A | 6/2010 |
| CN | 101870343 | A | 10/2010 |
| CN | 101870344 | A | 10/2010 |
| CN | 101870346 | A | 10/2010 |
| CN | 101871382 | A | 10/2010 |
| CN | 101927817 | A | 12/2010 |
| CN | 201914426 | U | 8/2011 |
| CN | 202264871 | U | 6/2012 |
| CN | 202574577 | U | 12/2012 |
| CN | 202574578 | U | 12/2012 |
| CN | 101875396 | B | 9/2013 |
| CN | 103373451 | A | 10/2013 |
| CN | 103373453 | A | 10/2013 |
| CN | 103419908 | A | 12/2013 |
| CN | 203381780 | U | 1/2014 |
| CN | 203567910 | U | 4/2014 |
| CN | 203593146 | U | 5/2014 |
| CN | 101879934 | B | 9/2014 |
| CN | 101879934 | B2 | 9/2014 |
| CN | 104229063 | A | 12/2014 |
| CN | 104229088 | A | 12/2014 |
| CN | 204056245 | U | 12/2014 |
| CN | 104260845 | A | 1/2015 |
| CN | 104260869 | A | 1/2015 |
| CN | 104295419 | A | 1/2015 |
| CN | 204124333 | U | 1/2015 |
| CN | 204197224 | U | 3/2015 |
| CN | 204197225 | U | 3/2015 |
| CN | 204197244 | U | 3/2015 |
| CN | 204197245 | U | 3/2015 |
| CN | 204197246 | U | 3/2015 |
| CN | 204197248 | U | 3/2015 |
| CN | 204197257 | U | 3/2015 |
| CN | 204197259 | U | 3/2015 |
| CN | 204197260 | U | 3/2015 |
| CN | 204197261 | U | 3/2015 |
| CN | 204200363 | U | 3/2015 |
| CN | 204200365 | U | 3/2015 |
| CN | 204200366 | U | 3/2015 |
| CN | 204200367 | U | 3/2015 |
| CN | 204200423 | U | 3/2015 |
| CN | 204200424 | U | 3/2015 |
| CN | 204200433 | U | 3/2015 |
| CN | 204200443 | U | 3/2015 |
| CN | 204436577 | U | 7/2015 |
| CN | 103661833 | B | 3/2016 |
| CN | 205131588 | U | 4/2016 |
| CN | 105691563 | A | 6/2016 |
| CN | 205418042 | U | 8/2016 |
| CN | 205469703 | U | 8/2016 |
| CN | 205469704 | U | 8/2016 |
| CN | 104309792 | B | 9/2016 |
| CN | 105947135 | A | 9/2016 |
| CN | 105966562 | A | 9/2016 |
| CN | 105966563 | A | 9/2016 |
| CN | 105966564 | A | 9/2016 |
| CN | 105966565 | A | 9/2016 |
| CN | 106005300 | A | 10/2016 |
| CN | 106054707 | A | 10/2016 |
| CN | 205632952 | U | 10/2016 |
| CN | 106081001 | A | 11/2016 |
| CN | 205675195 | U | 11/2016 |
| CN | 206054103 | U | 3/2017 |
| CN | 104228695 | B | 4/2017 |
| CN | 206087218 | U | 4/2017 |
| CN | 106846757 | A | 6/2017 |
| CN | 206297715 | U | 7/2017 |
| CN | 206317993 | U | 7/2017 |
| CN | 206446772 | U | 8/2017 |
| CN | 206466156 | U | 9/2017 |
| CN | 206466161 | U | 9/2017 |
| CN | 206466166 | U | 9/2017 |
| CN | 206466174 | U | 9/2017 |
| CN | 206466180 | U | 9/2017 |
| CN | 206466191 | U | 9/2017 |
| CN | 206471439 | U | 9/2017 |
| CN | 206471884 | U | 9/2017 |
| CN | 206606355 | U | 11/2017 |
| CN | 105923116 | B | 1/2018 |
| CN | 107628209 | A | 1/2018 |
| CN | 206914584 | U | 1/2018 |
| CN | 206984297 | U | 2/2018 |
| CN | 207010363 | U | 2/2018 |
| CN | 107776839 | A | 3/2018 |
| CN | 207129115 | U | 3/2018 |
| CN | 107953977 | A | 4/2018 |
| CN | 207257921 | U | 4/2018 |
| CN | 207389479 | U | 5/2018 |
| CN | 207389513 | U | 5/2018 |
| CN | 108189978 | A | 6/2018 |
| CN | 207450184 | U | 6/2018 |
| CN | 207496901 | U | 6/2018 |
| CN | 207496902 | U | 6/2018 |
| CN | 207510694 | U | 6/2018 |
| CN | 207550443 | U | 6/2018 |
| CN | 207550444 | U | 6/2018 |
| CN | 207670628 | U | 7/2018 |
| CN | 108357650 | A | 8/2018 |
| CN | 207683736 | U | 8/2018 |
| CN | 207683737 | U | 8/2018 |
| CN | 104260846 | B | 9/2018 |
| CN | 108482604 | A | 9/2018 |
| CN | 207851575 | U | 9/2018 |
| CN | 109263823 | A | 1/2019 |
| CN | 109334890 | A | 2/2019 |
| CN | 107215436 | B | 3/2019 |
| CN | 208715417 | U | 4/2019 |
| CN | 208715431 | U | 4/2019 |
| CN | 208715437 | U | 4/2019 |
| CN | 208715455 | U | 4/2019 |
| CN | 208760858 | U | 4/2019 |
| CN | 208760859 | U | 4/2019 |
| CN | 208760860 | U | 4/2019 |
| CN | 208760861 | U | 4/2019 |
| CN | 208760862 | U | 4/2019 |
| CN | 208789898 | U | 4/2019 |
| CN | 208855842 | U | 5/2019 |

(56) References Cited

FOREIGN PATENT DOCUMENTS

| | | | |
|---|---|---|---|
| CN | 209000208 | U | 6/2019 |
| CN | 110039578 | A | 7/2019 |
| CN | 10085788 | A | 8/2019 |
| CN | 110171092 | A | 8/2019 |
| CN | 110182331 | A | 8/2019 |
| CN | 209253549 | U | 8/2019 |
| CN | 209258326 | U | 8/2019 |
| CN | 209258351 | U | 8/2019 |
| CN | 209258352 | U | 8/2019 |
| CN | 107128454 | B | 9/2019 |
| CN | 107933845 | B | 9/2019 |
| CN | 209366402 | U | 9/2019 |
| CN | 209366403 | U | 9/2019 |
| CN | 209366404 | U | 9/2019 |
| CN | 209366405 | U | 9/2019 |
| CN | 209366406 | U | 9/2019 |
| CN | 209366407 | U | 9/2019 |
| CN | 209366408 | U | 9/2019 |
| CN | 209441573 | U | 9/2019 |
| CN | 110362080 | A | 10/2019 |
| CN | 10562408 | A | 12/2019 |
| CN | 209766523 | U | 12/2019 |
| CN | 10683005 | A | 1/2020 |
| CN | 108407991 | B | 1/2020 |
| CN | 209921564 | U | 1/2020 |
| CN | 209921565 | U | 1/2020 |
| CN | 209938884 | U | 1/2020 |
| CN | 110816758 | A | 2/2020 |
| CN | 110844006 | A | 2/2020 |
| CN | 210068712 | U | 2/2020 |
| CN | 110911888 | A | 3/2020 |
| CN | 110901869 | B | 6/2020 |
| DE | 102014005314 | A1 | 10/2015 |
| DE | 202017103703 | U1 | 7/2017 |
| DE | 202017107819 | U1 | 1/2018 |
| DE | 202017107820 | U1 | 1/2018 |
| DE | 202017107821 | U1 | 1/2018 |
| DE | 202017107824 | U1 | 1/2018 |
| DE | 202017107826 | U1 | 1/2018 |
| DE | 102017130946 | A1 | 6/2019 |
| DE | 102017130949 | A1 | 6/2019 |
| DE | 102017130955 | A1 | 6/2019 |
| DE | 102017130959 | A1 | 6/2019 |
| DE | 102017130963 | A1 | 6/2019 |
| DE | 102017130966 | A1 | 6/2019 |
| DE | 102018100696 | A1 | 6/2019 |
| DE | 102018129501 | A1 | 9/2019 |
| EP | 1153639 | Y | 7/2016 |
| EP | 3041735 | A1 | 7/2016 |
| EP | 3526112 | A1 | 8/2019 |
| EP | 3526113 | A1 | 8/2019 |
| EP | 3529142 | A1 | 8/2019 |
| EP | 3529143 | A1 | 8/2019 |
| EP | 3277574 | B1 | 11/2019 |
| FR | 3078680 | B1 | 5/2020 |
| GB | 2580022 | A | 7/2020 |
| HK | 1250973 | A1 | 1/2019 |
| IN | 200701396 | | 7/2008 |
| IN | 200701396 | I2 | 7/2008 |
| JP | 5221737 | B2 | 6/2013 |
| JP | 5791376 | B2 | 10/2015 |
| KR | 100572804 | B1 | 4/2006 |
| KR | 101024595 | B1 | 3/2011 |
| KR | 101491661 | B1 | 2/2015 |
| KR | 2017-0090702 | A | 8/2017 |
| KR | 20170090702 | A | 8/2017 |
| KR | 101978043 | B1 | 8/2019 |
| KR | 102050718 | B1 | 1/2020 |
| KR | 102095292 | B1 | 3/2020 |
| KR | 102095294 | B1 | 3/2020 |
| NO | 20181547 | A1 | 6/2020 |
| PL | 3277574 | T3 | 6/2020 |
| TW | M257328 | U | 2/2005 |
| TW | M308901 | U | 4/2007 |
| TW | 200848320 | A | 12/2008 |
| TW | 201000361 | A | 1/2010 |
| TW | I334793 | B | 12/2010 |
| TW | M461592 | U | 9/2013 |
| TW | I605324 | B | 11/2017 |
| TW | M552465 | U | 12/2017 |
| WO | 9200873 | | 1/1992 |
| WO | 2002092420 | A1 | 11/2002 |
| WO | 2005058685 | A1 | 6/2005 |
| WO | 2006/014085 | A1 | 2/2006 |
| WO | 2006014085 | A1 | 2/2006 |
| WO | 2006042359 | A1 | 4/2006 |
| WO | 2019/122185 | A2 | 6/2007 |
| WO | 2007072185 | A2 | 6/2007 |
| WO | 2009/144400 | A2 | 12/2009 |
| WO | 2009144400 | A2 | 12/2009 |
| WO | 2011047431 | A1 | 4/2011 |
| WO | 2012013770 | A2 | 2/2012 |
| WO | 2013026714 | A1 | 2/2013 |
| WO | 2015039970 | A1 | 3/2015 |
| WO | 2016003121 | A1 | 1/2016 |
| WO | 2017069322 | A1 | 4/2017 |
| WO | 2017153338 | A1 | 9/2017 |
| WO | 2017221233 | A1 | 12/2017 |
| WO | 2018149044 | A1 | 8/2018 |
| WO | 2018234969 | A1 | 12/2018 |
| WO | 2019072196 | A1 | 4/2019 |
| WO | 2019073126 | A1 | 4/2019 |
| WO | 2019122087 | A1 | 6/2019 |
| WO | 2019122091 | A1 | 6/2019 |
| WO | 2019122098 | A1 | 6/2019 |
| WO | 2019122176 | A1 | 6/2019 |
| WO | 2019122185 | A1 | 6/2019 |
| WO | 2019122225 | A1 | 6/2019 |
| WO | 2019122321 | A1 | 6/2019 |
| WO | 2019129687 | A1 | 7/2019 |
| WO | 2019141799 | A1 | 7/2019 |
| WO | 2019143276 | A1 | 7/2019 |
| WO | 2019183668 | A1 | 10/2019 |
| WO | 2019203135 | A1 | 10/2019 |
| WO | 2019222119 | A1 | 11/2019 |
| WO | 2020042299 | A1 | 3/2020 |
| WO | 2020042300 | A1 | 3/2020 |
| WO | 2020042301 | A1 | 3/2020 |
| WO | 2020042302 | A1 | 3/2020 |
| WO | 2020056822 | A1 | 3/2020 |
| WO | 2020056823 | A1 | 3/2020 |
| WO | 2020107665 | A1 | 6/2020 |
| WO | 2020113768 | A1 | 6/2020 |
| WO | 2020176033 | A1 | 9/2020 |

OTHER PUBLICATIONS

International Search Report and Written Opinion for International Application No. PCT/US2022/36179 dated Nov. 22, 2022.

Evolo Final Report, Apr. 23, 2009.

JetSurfing Nation jet boards & efoils, "Awake RÄVIK Premium Electric Surfboard—unboxing and review Part 1," https://www.youtube.com/watch?v=i3P9NWw4fpg, Oct. 1, 2019.

7M Engineering, "Assembly1," https://vimeo.com/361237245, Sep. 20, 2019.

Scrapheaper, "Trampofoil—the "originals* from Sweden, https://www.youtube.com/watch?v=QQvYogFP9mw&feature=youtu.be, Aug. 15, 2010.

Ray Vellinga, "Hydrofoil—Thrilling Swedish Invention," https://www.youtube.com/watch?v=kIAggNlir9A&feature=youtu.be, Oct. 27, 2011.

International Search Report for International Application No. PCT/US21/28696 dated Sep. 9, 2021.

Asa Bonthelius, "Hoglage," BATNYTT (Sep. 2009).

* cited by examiner

LEASH SYSTEM AND METHODS OF USE

FIELD

This disclosure relates to kill switch systems and, in particular, kill switch leash systems for use with watercraft.

BACKGROUND

Kill switches are often used to power off motorized devices quickly, for example, in an emergency situation. Kill switch systems often include a key that when attached to a kill switch enables the motorized device to operate and when detached from the kill switch inhibits the motorized device from operating. The key is often easily detachable or removable from the kill switch so that the key can easily be removed from the key switch to shut off the motorized device.

Some kill switch systems include a cord that is attached to a user such that when the user moves more than a certain distance away from the motorized device, the cord pulls the key from the kill switch causing the motorized device to cease operation. Examples of motorized devices including such a kill switch system include treadmills and jetskis. For instance, when a user falls off a jetski, the key is removed from the kill switch causing the jetski to turn off.

A problem exists with current watercraft, such as jetskis or hydrofoiling surfboards, in that when the user falls off the watercraft the watercraft may be pushed by current, waves, wind, or otherwise float away from the user. As a result, the user may have to swim after the watercraft and/or may lose the watercraft.

DETAILED DESCRIPTION

A leash system is provided for use with a motorized device, such as a personal watercraft. The leash system includes a key for connection to a kill switch of the personal watercraft, a leash cord, a switch cord, and an anchoring cord. The leash cord is configured to be affixed at a first end portion to a user of the personal watercraft. The switch cord has a first end portion affixed to the key and a second end portion affixed to a second end portion of the leash cord. The anchoring cord has a first end portion configured to fixedly secure the anchoring cord to the personal watercraft and a second end portion affixed to the second end portion of the leash cord.

In some examples, the leash system further includes a loop affixed along the anchoring cord that is configured to slidably receive the switch cord therethrough. When the leash cord is pulled taut (e.g., when the user falls off the watercraft) while the anchoring cord is fixedly secured to the personal watercraft, the first end portion of the switch cord is drawn toward the loop to remove the key from the kill switch. The loop may be positioned to ensure that the key will be removed from the kill switch regardless of the direction the user falls. The user remains tethered to the watercraft by the leash cord and the anchoring cord, permitting the user to pull themselves back toward the watercraft via the leash system upon falling off of the watercraft. In other examples, the leash system further includes a loop affixed along the switch cord that is configured to slidably receive the anchoring cord therethrough. The functional result of these examples is the same, causing the switch cord to remove the key from the kill switch regardless of the direction the user falls, and keeping the user tethered to the watercraft.

Figure 1:
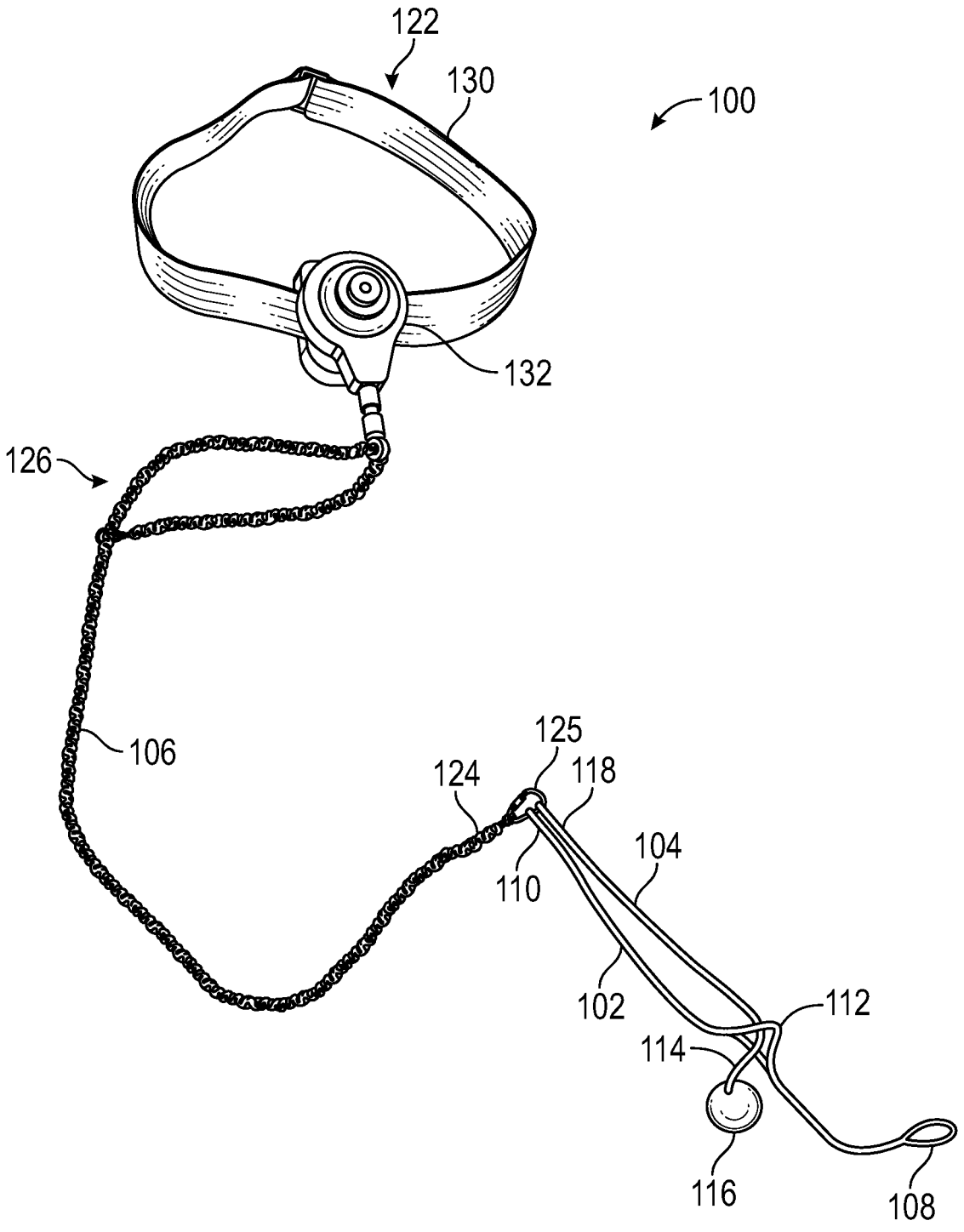
FIG. 1 is a perspective view of a leash system according to an embodiment of the present disclosure.

With reference to FIG. 1, a leash system 100 is shown according to an example embodiment. The leash system 100 includes an anchoring cord 102 and a switch cord 104 attached to a leash cord 106. The leash cord 106 may be secured to a user, for example, via harness 122.

The anchoring cord 102 may be formed of a rope, a cable, tubular webbing, flat webbing, or a chain as examples. The anchoring cord 102 may have, as examples, a length in the range of about six inches to about two feet. The length of the anchoring cord 102 may be selected based in part on the length of the switch cord 104 and the relative position of a loop 112 of the anchoring cord 102 as described in further detail below with regard to FIGS. 3A-B. The anchoring cord 102 includes an attachment end 108 for securing the leash system 100 to an anchoring point 134 on a motorized watercraft, such as, for example, a personalized watercraft such as a motorized surfboard, jetski, or the hydrofoiling watercraft 150 shown in FIGS. 2A-2C. The hydrofoiling watercraft 150 is described in further detail below.

The anchoring cord 102 includes a free end 110 at the end opposite the attachment end 108 for securing the anchoring cord 102 to the leash 106. The anchoring cord 102 includes the loop 112 through which the switch cord 104 extends. The loop 112 may be positioned proximate the attachment end 108 of the anchoring cord 102. The loop 112 permits the switch cord 104 to slide within the loop 112. In one form where the anchoring cord 106 is formed of a rope, the loop 112 is formed by separating two strands of the rope apart from one another and passing a portion of the switch cord 104 through the loop 112. In another form, a ring is positioned between the strands of the rope of the anchoring cord 102 to provide a loop 112 having less friction for the switch cord 104 to slide along. As one example, the ring may be a RopeGlide™ Ring sold by Ronstan International Inc., 1170 East Main Road #3, Portsmouth, Rhode Island 02871. The loop 112 may also be attached to the side of the anchoring cord 102. For example, the loop 112 may be a ring attached at one end to and partially offset from the anchoring cord 102.

The switch cord 104 may also be formed of a rope, a cable, tubular webbing, flat webbing, or a chain as examples. The switch cord 104 may have, as examples, a length in the range of about six inches to about two feet. The length of the switch cord 104 may be selected based in part on the length of the anchoring cord 102 and the relative position of the loop 112 of the anchoring cord 102 as described in further detail below with regard to FIGS. 3A-B. The switch cord 104 includes a key end 114 that is attached to a key 116 of a kill switch. The switch cord 104 extends from the key end 114 through the loop 112 of the anchoring cord 102 to a free end 118. The free end 118 of the switch cord 104 is attached to the leash 106. While the switch cord 104 and the anchoring cord 102 are described as being separate cords, in some forms, the anchoring cord 102 and the switch cord 104 are formed from the same cord that is attached to the leash 106 at a midpoint of the cord. The midpoint of the cord is attached to the leash 106 with one end of the cord extending toward the attachment end 108 and forming the anchoring cord 102 and the other end of the cord extending toward the key end 114 and forming the switch cord 104.

Figure 2A:
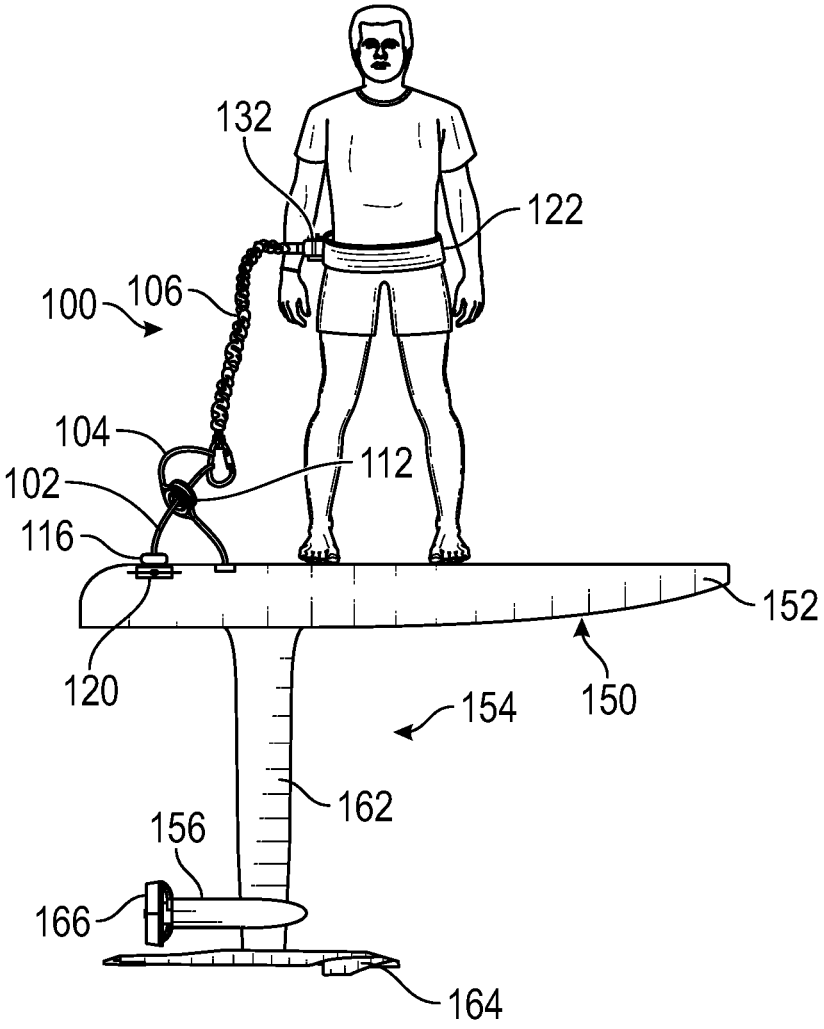
FIG. 2A is a side schematic view of a leash system of FIG. 1 in use with a user on a hydrofoiling watercraft.
Figure 2B:
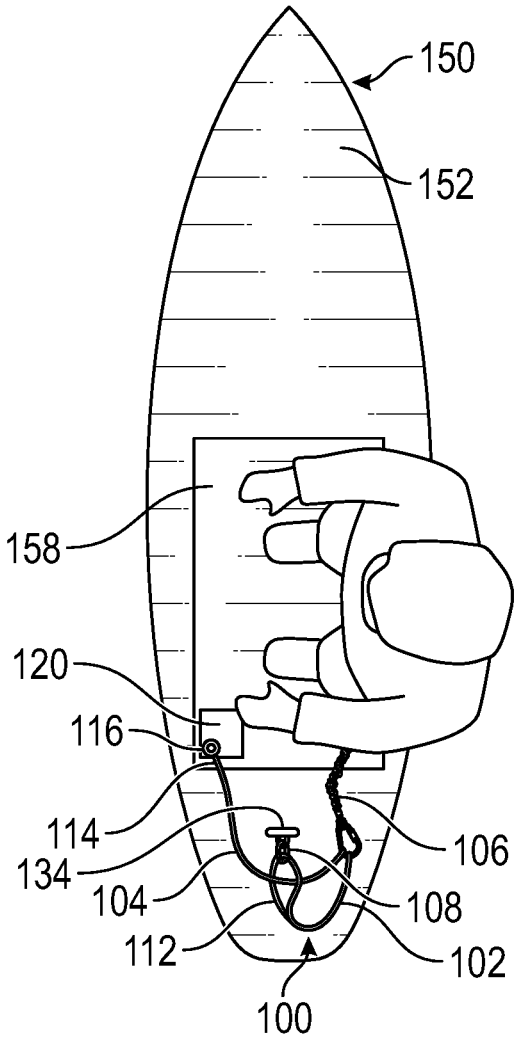
FIG. 2B is a top schematic of the leash system of FIG. 1 with the user on the hydrofoiling watercraft of FIG. 2A.
Figure 2C:
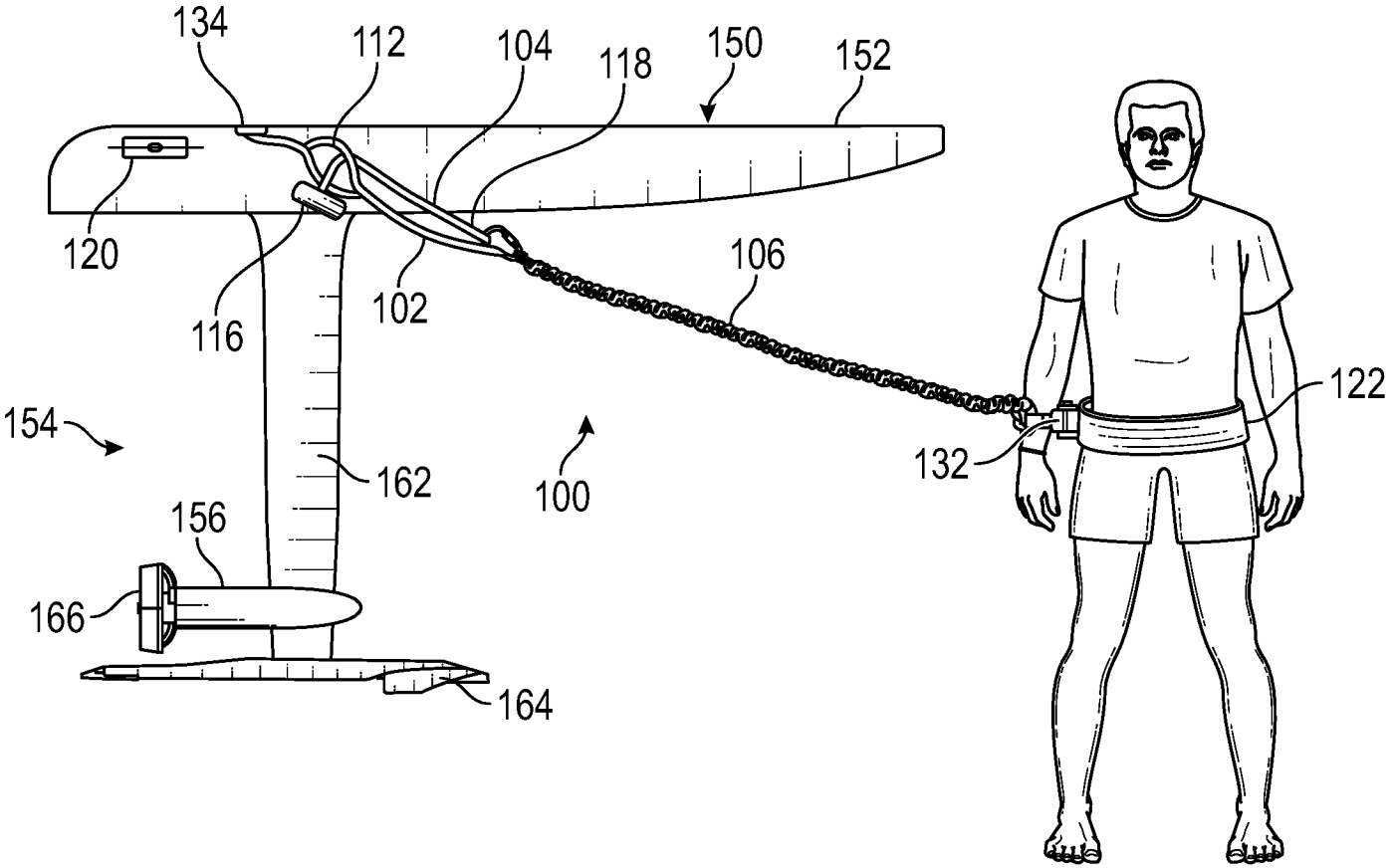
FIG. 2C is a side schematic view of the leash system of FIG. 1 in use with the hydrofoiling watercraft of FIG. 2A where the user has fallen off of the watercraft.

With reference to FIG. 2C, when the leash cord 106 pulls against the free end 118 of the switch cord 104, for example when the user falls off of the watercraft 150, the leash cord 106 is drawn taut pulling a portion of the illustrated switch cord 104 through the loop 112. When the illustrated switch cord 104 is drawn taut, the key 116 is drawn toward the loop 112. Drawing the key 116 toward the loop 112 causes the key 116 to become disconnected from the kill switch 120 causing the watercraft 150 to shut off.

The key 116 may be a configured to interact with a kill switch 120 of the watercraft 150 as shown in FIGS. 2A-C. The key 116 may be, as example, a plastic key that is inserted into a receiving slot of the kill switch 120 or a magnet configured to be magnetically attached to a portion of the kill switch 120. The kill switch 120 may include a capacitive or inductive sensor to determine whether the key 116 is attached the kill switch 120. The kill switch 120 may be configured to be closed, or otherwise permit power to be delivered to operate the watercraft 150, when the key 116 is engaging the kill switch 120 as shown in FIGS. 2A-B. For example, where the key 116 includes a magnet, the kill switch 120 may be closed when the magnet is attached to and proximate the kill switch 120. A user attaches the key 116 to the kill switch 120 when they are on the watercraft 150 and ready to operate it. In this example the kill switch 120 is configured to be opened, or inhibit power to be delivered to operate the watercraft 150, when the key 116 is removed from or not engaging the kill switch 120 as shown in FIG. 2C. While the kill switch 120 is described as a switch being closed or opened, those having skill in the art will readily appreciate that the kill switch 120 may also have the form of a sensor communicatively coupled to a controller of the watercraft 150, where the controller is configured to prevent the motor from being operated when the sensor does not detect that the key 116 is attached to the kill switch 120.

Figure 4:
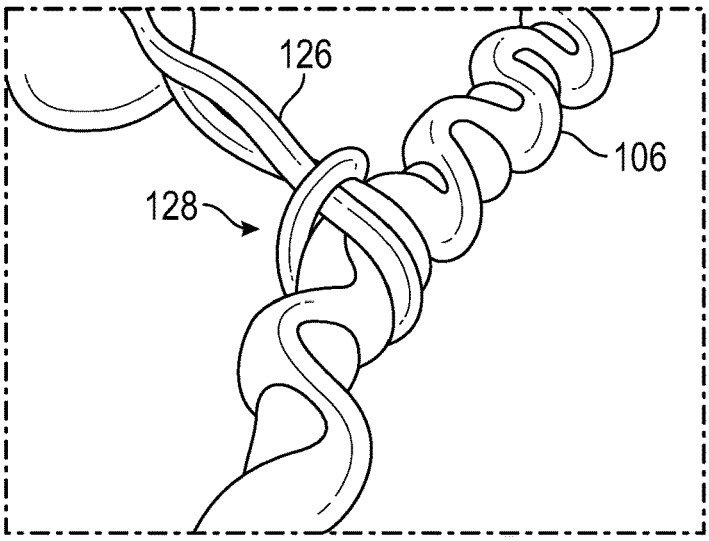
FIG. 4 is a perspective view of a knot used to set the length of a leash cord of the leash system of FIG. 1A.

The leash cord 106 extends from the anchoring cord 102 and the switch cord 104 to the harness 122. The leash cord 106 may be an elastic cord formed of an elastic material permitting the leash cord to expand in length when pulled taut and to retract to its original length when force is no longer applied. This may enable the leash cord 106 to absorb some of the shock experienced by a user when falling off the watercraft and into the water while the watercraft is still moving forward, thus reducing forces experienced by the user if the watercraft 150 proceeds away from the user and extends to the full length of the leash 100. As examples, the leash cord 106 may have a length in the range of about 1 meter to about 1.5 meters in its relaxed configuration. In one particular example, the leash cord 106 has a length of about 1.3 meters in the relaxed configuration. The leash cord 106 includes an end 124 for attachment to the free end 110 of the anchoring cord 102 and the free end 118 of the switch cord 104. The leash cord 106 may include a ring or a clip 125 at the end 124 for attachment to the free end 110 of the anchoring cord 102 and a free end 118 of the switch cord 104. The leash cord 106 extends to the opposite end 126 for attachment to a user. In some forms, the leash 106 may be attached directly to a user. In other forms, as shown in FIG. 1, the end 126 of the leash cord 106 is attached to a harness 122. The length of the leash cord 106 may be adjusted by looping the end 126 of the leash cord 106, or doubling back the end 126, and attaching the end 126 to a portion of the leash cord 106 between the harness 122 and the opposite end 124. As shown in FIG. 4, the end 126 may be secured to a portion of the leash cord 106 by a knot 128, such as a lark's head knot as shown.

The harness 122 includes a strap 130 for securing the harness to a user. The strap 130 may wrap around the waist and/or chest of a user. The strap 130 may include a buckle and/or a strap adjuster slip lock mechanism for securing and cinching the strap 130 to a user. In the illustrated example, the harness 122 includes a retractable spool 132 attached to the strap 130. The retractable spool 132 includes a spool of cable that is configured to unwind from the spool when the cable is pulled with sufficient force to overcome the biasing force of the retractable spool 132 winding the cable on the spool 132. As shown, the end of the cable is attached to the end 126 of the leash 106. When the user falls of the watercraft and into the water during operation of the watercraft, the watercraft may continue to glide through the water due to inertia, despite power being shut off by the kill switch. The user, upon falling into the water, will be quickly brought to a stop by the water. As a result of the difference in the velocity of the user and the watercraft 150, attachment of the user by a cord to the watercraft 150 may result in the user being jerked by the watercraft 150 when the watercraft extends beyond the length of the cord. To reduce this jerk on the user, the retractable spool 132 may dispense cable to extend the distance between the user and the watercraft 150 while still tethering the user to the watercraft 150. Upon falling off, the user may wait for the retractable spool 132 to cease dispensing cable, such as when the watercraft 150 is brought to a substantial stop, and then draw themselves back toward the watercraft 150 by pulling on the cable to rewind the cable on the spool 132. Thus, the retractable spool 132 allows the user to fall of the watercraft and remain tethered to the watercraft, and reduces jerk from the watercraft. The user can draw themselves back toward the watercraft by pulling on the cable and/or leash cord 106 without having to expend energy swimming after the watercraft. The length of the cable wound about the spool 132 is preferably in the range of about 8 feet to about 15 feet. In one particular example, the length of the cable of the spool 132 is 10 feet.

In some forms, the retractable spool 132 automatically rewinds the dispensed cable back onto the spool. As one example, the retractable spool 132 may have a spring mechanism that applies a biasing force to the spool toward a wound configuration. As another example, the retractable spool 132 may include a motor that winds the spool to rewind the cable onto the spool 132. The retractable spool 132 may have a button that the user presses to causes the spool 132 to wind. The retractable spool 132 thus may serve as a winch when operated, drawing the user and the watercraft 150 toward one another.

Figure 3A:
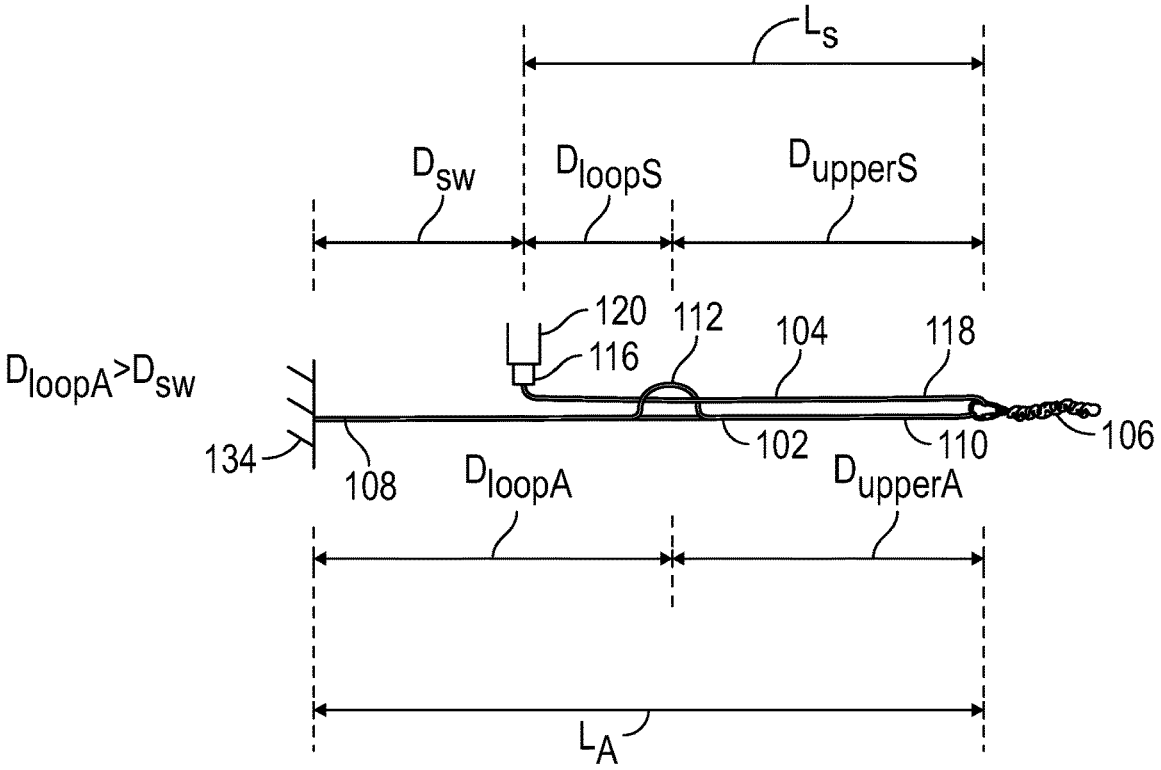
FIG. 3A is a schematic view of the leash system of FIG. 1A in use with a kill switch according to a first configuration.
Figure 3B:
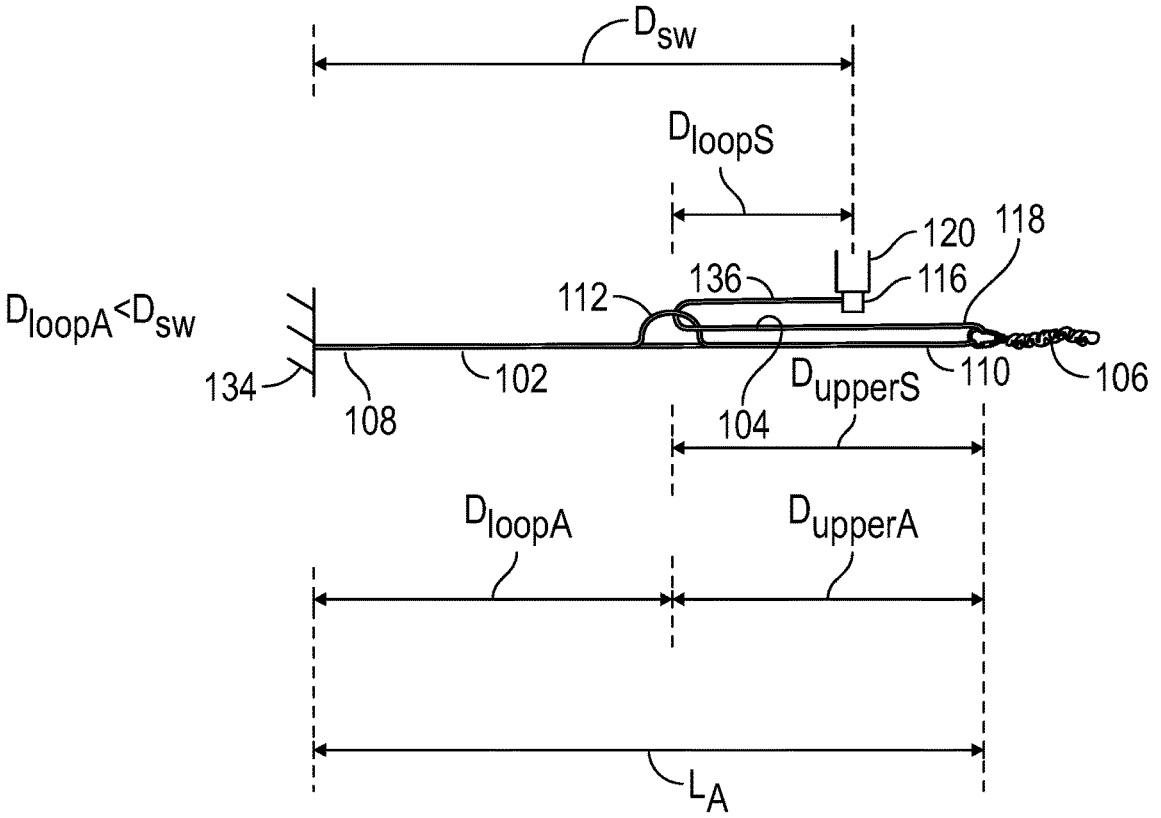
FIG. 3B is a schematic view of the leash system of FIG. 1A in use with the kill switch according to a second configuration.

With reference to FIGS. 3A-B, the loop 112 of the anchoring cord 102 may be positioned along the anchoring cord 102 to ensure that when the key 116 is drawn toward the loop 112 (e.g., when the user falls off the watercraft 150), the key 116 becomes disconnected from the kill switch 120. To ensure that the kill switch 120 will become disconnected regardless of which way the user falls of the watercraft 150, the distance from the attachment end 108 of the anchoring cord 102 to the loop 112 ($D_{LOOP,A}$) must be a different length than the distance from the anchoring point 134 of the watercraft 150 to which the attachment end 108 of the anchoring cord 102 is attached to the kill switch 120 ($D_{SW}$). In other words, $D_{LOOP,A}$ should be a different length than $D_{SW}$ to ensure that the loop 112 can never be positioned on the kill switch 120, in which case pulling the key 116 toward the loop 112 would not necessarily remove the key 116 from the kill switch 120.

To ensure that drawing the switch cord 104 taut removes the key 116 from the kill switch 120, the length of the switch cord 104 may be determined relative to the length of the anchoring cord 102 and the position of the loop 112. In view of the above, the leash system 100 has two primary configurations: a first configuration where $D_{LOOP,A}$ is greater than $D_{SW}$ as shown in FIG. 3A; and a second configuration where $D_{LOOP,A}$ is less than $D_{SW}$ as shown in FIG. 3B. In either configuration the length of the switch cord 104 ($L_S$) must be greater than the length from the free end 118 of the switch cord 104 to the loop 112 of the anchoring cord 102 ($D_{UPPER,S}$). Or, $L_S > D_{UPPER,S}$.

With respect to FIG. 3A, the first configuration of the leash system 100 is shown where the distance from the attachment end 108 to the loop 112 ($D_{LOOP,A}$) is greater than the distance from the anchoring point 134 of the watercraft 150 to which the attachment end 108 of the anchoring cord 102 is attached to the kill switch 120 ($D_{SW}$). To ensure that the key 116 will be removed from the kill switch 120, the length of the switch cord 104 ($L_S$) is less than the than the difference between a length of the anchoring cord ($L_A$) from its attachment end 108 to its free end 110 and the distance from the attachment end 108 of the anchoring cord 104 to the kill switch 120 of the watercraft 150 ($D_{SW}$). Or, $L_S < L_A - D_{SW}$.

With respect to FIG. 3B, the second configuration of the leash system 100 is shown where the distance from the attachment end 108 to the loop 112 ($D_{LOOP,A}$) is less than the distance from the anchoring point 134 of the watercraft 150 to which the attachment end 108 of the anchoring cord 102 is attached to the kill switch 120 ($D_{SW}$). In this configuration, to ensure that the key 116 will be removed from the kill switch 120, the length of the switch cord 104 ($L_S$) is less than a length of the anchoring cord 102 ($L_A$) subtracted from the sum of the distance from the attachment end 108 of the anchoring cord 102 to the kill switch 120 of the watercraft ($D_{SW}$) and a distance from the free end 110 of the anchoring cord 102 to the loop 112 ($D_{UPPER,S}$) and a distance from the free end 118 of the switch cord 104 to the loop 112 ($D_{UPPER,A}$). Or, $L_S < D_{SW} + D_{UPPER,S} + D_{UPPER,A} - L_A$.

In both of these embodiments of FIGS. 3A-B, the leash system 100 should be configured so that when the leash cord 106 is pulled taut against the switch cord 104, a length between the loop 112 and the kill switch 120 ($D_{LOOP,S}$) is greater than a length of a portion 136 of the switch cord 102 extending from the loop 112 to the key 116. This should be the case where the loop 112 is at its closest point to the kill switch 120 to ensure that the key 116 will be detached from the kill switch 120 when the switch cord 104 is pulled in any direction.

In operation, a user may use the leash system 100 to disable the watercraft 150 when the user falls off of the watercraft 150. The user attaches a first end 126 of the leash cord 106 to their self. The user attaches the end 126 of the leash cord 106 to a harness 122 or strap 130 attached to the user. The harness 122 may be secured to the user's chest or waist as examples. The user may cinch or tighten the harness 122 to secure the leash cord 106 to the user.

In the illustrated example, a second end 124 of the leash cord 106 is attached to an anchoring cord 102 and a switch cord 104. The anchoring cord 102 and switch cord 104 may be secured to the leash cord 106 by the clip 125 at the end 124 of the anchoring cord 102 and the switch cord 104. The attachment end 108 of the anchoring cord 102 is affixed to the watercraft 150. In some forms, the watercraft 150 may have a ring or loop at an attachment point 134 for the attachment end 108 of the anchoring cord 102 to be tied or clipped to. In other forms, the attachment end 108 may be secured to another fixture of the watercraft 150, such as a handle for carrying and/or moving the watercraft 150. Once the anchoring cord 102 is secured to the watercraft 150 and the leash cord 106 and the leash cord 106 is secured to the user, the user is tethered to the watercraft 150.

The user may mount the watercraft 150 or position themselves on the watercraft 150 to operate the watercraft 150. To enable the watercraft 150 to operate, the user secures the key 116 attached to the switch cord 104 to the kill switch 120 of the watercraft 150. The user may then operate the watercraft 150 until the key 116 is removed from the kill switch 120, causing the watercraft to cease operation. The key 116 may become disconnected or removed from the kill switch 120, causing the watercraft 150 to cease operation, when the leash cord 106 is pulled taught against the anchoring cord 102. For example, the leash cord 106 may be pulled taught against the anchoring cord 102 when the user falls off of the watercraft 150.

When the leash cord 106 is pulled taut or the second end 124 of the leash cord 106 is moved more than a certain distance from the anchoring point 134, the second end 124 of the leash cord 106 pulls the switch cord 104 through the opening or loop 112 of the anchoring cord 102. As the switch cord 104 is drawn through the loop 112, the key 116 is drawn toward the loop 112 and disconnected from the kill switch 120 of the watercraft 150. The user remains tethered to the watercraft 150 even when the key 116 is disconnected from the kill switch 120 via the leash cord 106 through its attachment to the anchoring cord 102 and the anchoring cord 102 through its attachment to the watercraft 150.

In another embodiment, the loop 112 is affixed along the switch cord 104 rather than the anchoring cord 102. The anchoring cord 102 extends through the loop 112 of the switch cord 104 and the loop 112 may be slid over the anchoring cord 102. As the leash cord 106 is pulled taut, the loop 112 of the switch cord 104 is slid along the anchoring cord 102. When the switch cord 104 is slid a certain distance such that the switch cord 104 is pulled substantially taut, the key 114 is pulled away from and disconnected from the kill switch 120.

In some embodiments, the anchoring cord 102 is elastic or includes an elastic portion between the attachment end 108 and the free end 110 of the anchoring cord 102. In some forms, the anchoring cord 102 is a part of or an extension to the leash cord 106. When the leash cord 106 is pulled taut such that the anchoring cord 102 is expanded more than a certain distance, the switch cord 104 is drawn through the loop 112 of the anchoring cord 102. The switch cord 104 is preferably inelastic, to pull the key 114 along with the switch cord 104 toward the loop 112 of the anchoring cord 102. As the key 114 is drawn toward the loop 112, the key 114 is disconnected from the kill switch 120.

With reference again to FIGS. 2A-C, the watercraft 150 shown is a hydrofoiling watercraft having a board 152, a hydrofoil 154, and an electric propulsion unit 156 mounted to the hydrofoil 154. The hydrofoiling watercraft 150 may be similar to, for example, the hydrofoiling watercrafts disclosed in U.S. Pat. Nos. 10,940,917 and 10,946,939 which are both hereby incorporated herein by reference in their entireties. The board 152 may be a rigid board formed of fiberglass, carbon fiber or a combination thereof, or an inflatable board. The top surface of the board 152 forms a deck on which a user or rider may lay, sit, kneel, or stand to operate the watercraft 150. The deck may include a rubber layer to provide increased friction to support the user from slipping or sliding on the top surface of the board 152.

The hydrofoiling watercraft 150 may further include a battery box 158 that is mounted into a cavity on the top side of the board 102. The battery box 158 may include and/or house the kill switch 120. The battery box 158 may house a battery for powering the watercraft 150, an intelligent power unit (IPU) that controls the power provided to the electric propulsion unit 156, communication circuitry, Global Navigation Satellite System (GNSS) circuitry, and/or a computer (e.g., processor and memory) for controlling the watercraft or processing data collected by one or more sensors of the watercraft 150. The watercraft 150 may determine the location of the watercraft at any given time using the GNSS circuitry. The communication circuitry may be configured to communicate with a wireless remote controller operable by the user to control the watercraft 150.

The hydrofoil 154 includes a strut 162 and one or more hydrofoil wings 164. The propulsion unit 156 may be mounted to the strut 162. Power wires and a communication cable may extend through the strut 162 from the battery box 158 to provide power and operating instructions to the propulsion unit 156. The propulsion unit 156 may contain an electronic speed controller (ESC) and a motor. In some embodiments, the propulsion unit 156 also includes the battery and/or the IPU. The motor includes a shaft that is coupled to a propeller 166. The ESC provides power to the motor based on the control signals received from the IPU of the battery box 158 to operate the motor and cause the shaft of the motor to rotate. Rotation of the shaft turns the propeller which drives the watercraft 150 through the water. In other forms, a waterjet may be used in place of the propeller to drive the watercraft 150 through the water.

As the hydrofoiling watercraft 150 is driven through the water, the water flowing over the hydrofoil wings 164 provides lift. This causes the board 152 to rise above the surface of the water when the watercraft 150 is operated at or above certain speeds such that sufficient lift is created. While the hydrofoil wings 164 are shown mounted to the base of the strut 162, in other forms, the hydrofoil wings 164 may extend from the propulsion unit 156. The propulsion unit 156 thus may be a fuselage from which hydrofoil wings 164 extend. In some forms, the hydrofoil wings 164 are mounted above the propulsion unit 156 and closer to the board 152 than the propulsion unit 156.

Figure 5A:
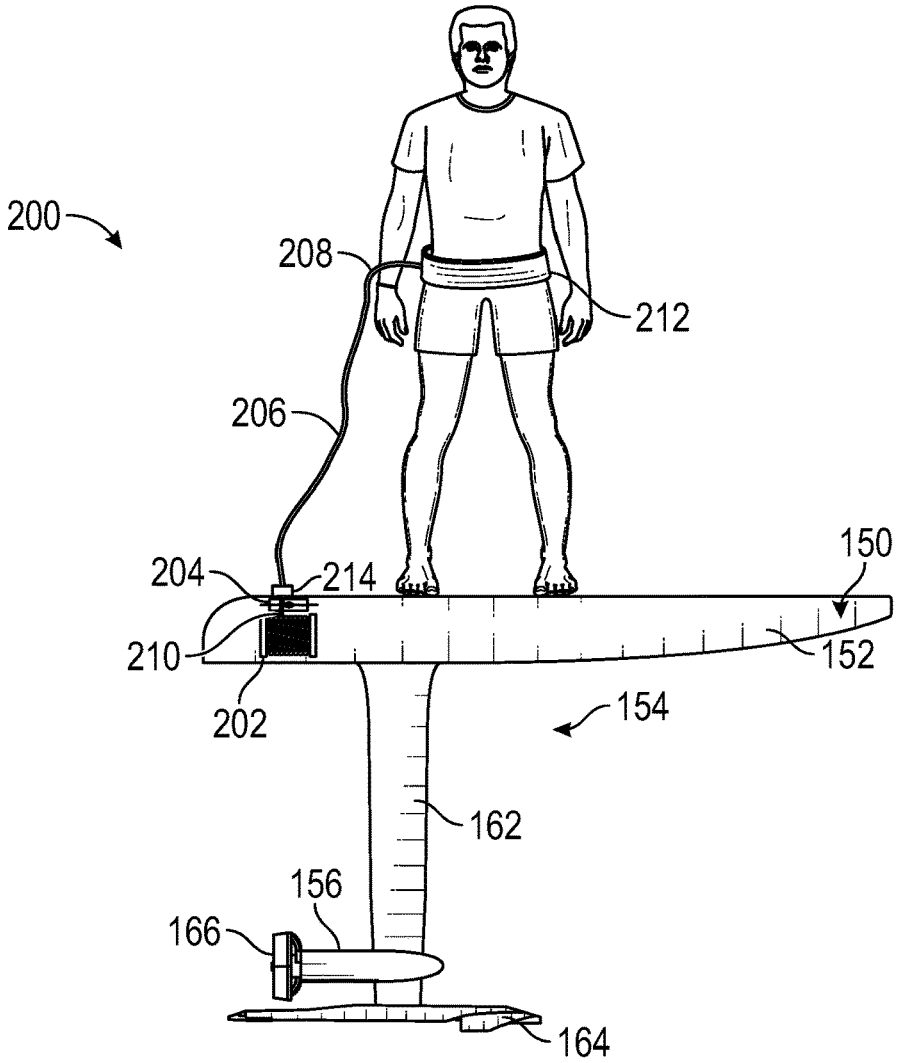
FIG. 5A is a side schematic view of a leash system according to another embodiment in use with a user on the hydrofoiling watercraft of FIG. 2A.
Figure 5B:
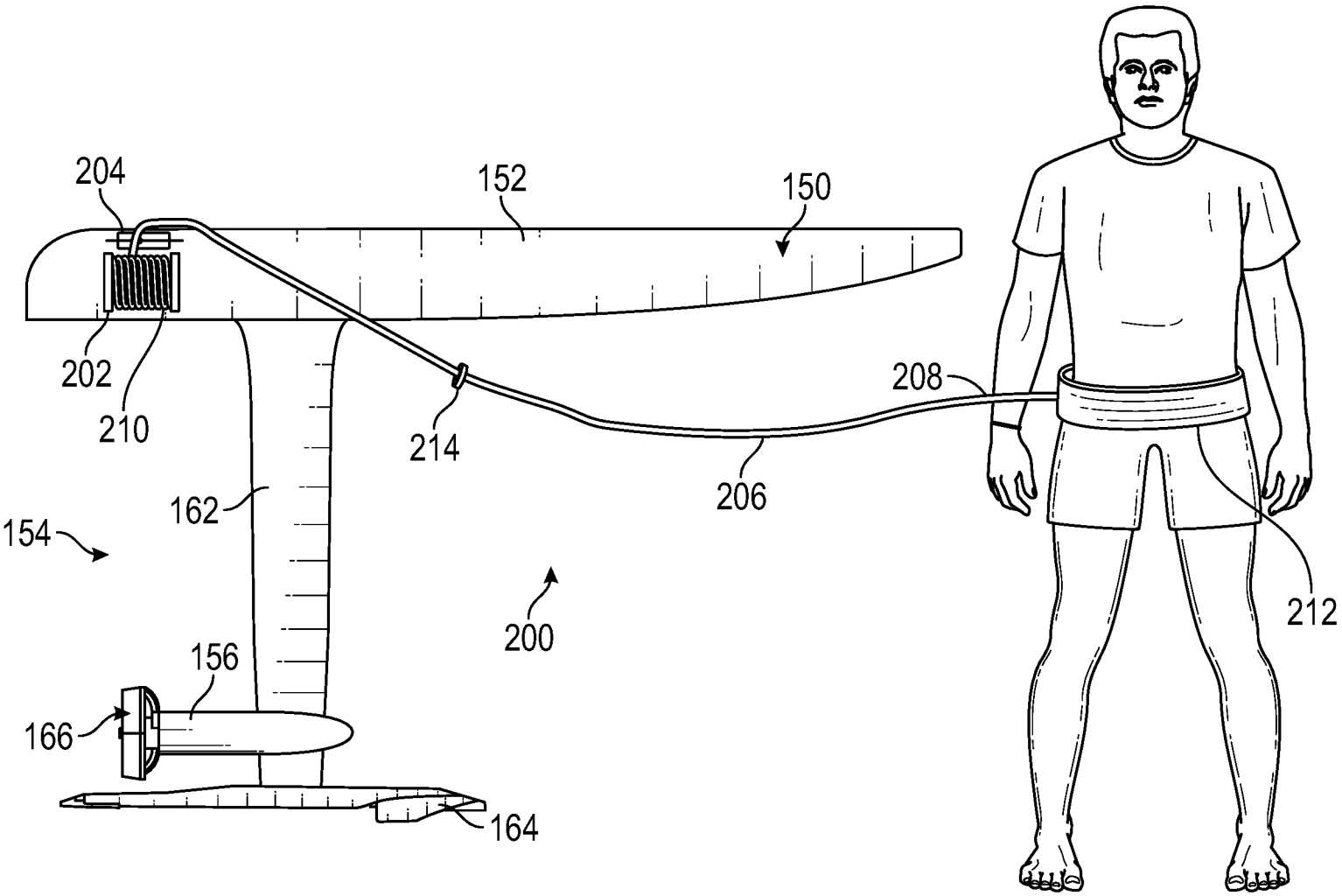
FIG. 5B is a side schematic view of a leash system of FIG. 5A in use with the hydrofoiling watercraft of FIG. 2A, where the user has fallen off of the watercraft.

With respect to FIGS. 5A-B, a leash system 200 is shown according to a second embodiment in use with a hydrofoiling watercraft 150. The leash system 200 is similar to the leash system 100 of the first embodiment in many respects, with the primary differences being highlighted in the following discussion. While the leash system 200 is shown in use with a hydrofoiling watercraft 150, those having skill in the art will readily appreciate the application of the leash system 200 with other watercraft. The leash system 200 includes the retractable spool 202 within the board 152 of the watercraft 150. In the embodiment shown, the retractable spool 202 is positioned within the board of a hydrofoiling surfboard. The retractable spool 202 may be positioned proximate the kill switch 204 of the watercraft 150.

The leash system 200 includes a leash cord 206 that has a user attachment end 208 and a watercraft attachment end 210. The user attachment end 208 of the leash cord 206 is configured to be attached to a user. The leash 206 may be attached the user by a harness 212. For example, the harness 212 may include a strap wrapped around the chest or waist the user. The attachment end 208 of the leash cord 206 may be affixed to the harness 212 to secure the leash cord 206 to the user.

The watercraft attachment end 210 of the leash cord 206 may be attached to and wound about the spool of the retractable spool 202. The leash cord 206 may include a key 214 attached along the leash cord 206 that is configured to be mounted to and interact with the kill switch 216 of the watercraft 150. In some forms, the key 214 is attached to the leash cord 206 via a switch cord extending between the key 206 and the leash cord 206. The retractable spool 202 may be configured to automatically wind the leash cord 206 about the spool to take up the slack in the leash cord 206. When the leash cord 206 is fully or substantially wound about the spool, the key 214 may be proximate or contacting the kill switch 216 of the watercraft 150. In some forms, the user may be required to insert the key 214 or bring the key 214 in contact with the kill switch 216 to cause the kill switch to be in the closed position to allow the watercraft 150 to operate. In other forms, when the leash cord 206 is fully or substantially wound about the spool, the key 214 may be brought into contact with the kill switch 216 which causes the kill switch 216 to be in the closed position, allowing the watercraft 150 to operate. For example, where the key 214 is a magnetic key, when the retractable spool 202 has wound the leash cord 206 about the spool, the key 214 is brought to be magnetically attached the kill switch 216 such that the kill switch 216 is closed.

In one embodiment, the key 214 serves as a stop for the retractable spool 202 and inhibits the retractable spool 202 from further winding any leash cord 206 about the spool 202. For instance, the retractable spool 202 draws the leash cord 206 through an opening in the watercraft 150. The key 214 may be sized to not fit through the opening thus inhibiting any more of the leash cord 206 from being wound about the spool when the key 214 is brought into contact with the portion of the watercraft 150 forming the opening. The key 214 may be configured to interact with the kill switch 216 such that when the key 214 is brought into contact with the opening in the watercraft 150, the key 214 is interacting with the kill switch 216 to permit the watercraft 150 to operate.

As shown in FIG. 5A, the user is on the watercraft 150 with the leash cord 206 affixed to their waist via a harness 212. The key 214 of the leash cord 206 is in contact with the kill switch 216 of the watercraft 150 such that the watercraft 150 may operate. A portion of the leash cord 206 extends from the key 214 and into the watercraft 150 and is wound about the retractable spool 202. The retractable spool 202 has taken up the slack within the leash cord 206.

With respect to FIG. 5B, the user has fallen off of the watercraft 150 and is in the water. As shown, the leash cord 206 has been pulled with the user as the user fell off of the watercraft 150. Pulling the leash cord 206 caused the key 214 to be pulled along with the leash cord 206, thus causing the key 214 to become detached from the kill switch 204. Since the key 214 is detached from the kill switch 204, the watercraft 150 has ceased operating and is not able to operate. This protects the user from potential injury from the rotation of the propeller and shuts off the propeller to prevent the watercraft 150 from moving further away from the user.

As the user falls off of the watercraft 150, the length of the leash cord 206 extending between the user and the watercraft 150 increases by unwinding the leash cord 206 from the retractable spool 202. The force of the user moving from the retractable spool 202 overcomes the biasing force of the retractable spool 202 that causes the spool to wind the leash cord 206 about the spool. Thus, the leash cord 206 is dispensed from the spool to the user until the force of the user moving away from the watercraft falls below a threshold value. As the user swims or moves toward the watercraft 150, the retractable spool 202 winds the excess amount of leash cord 206 about the spool 202. Once the user is back on the watercraft 150, the user may attach the key 214 to the kill switch 216 to resume operation of the watercraft 150.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A leash system for use with a personal watercraft, comprising:

a key for connection to a kill switch of the personal watercraft;

a leash cord configured to be affixed at a first end portion to a user of the personal watercraft;

a switch cord having a first end portion affixed to the key and a second end portion affixed to a second end portion of the leash cord;

an anchoring cord having a first end portion configured to fixedly secure the anchoring cord to the personal watercraft, and a second end portion affixed to the second end portion of the leash cord;

a loop affixed along the anchoring cord slidably receiving the switch cord therethrough;

wherein when the leash cord is pulled taut while the anchoring cord is fixedly secured to the personal watercraft, the first end portion of the switch cord is drawn toward the loop to remove the key from the kill switch.

2. The leash system of claim 1 wherein the key includes a magnet.

3. The leash system of claim 1 further comprising a harness configured to affix the leash system to the user, wherein the first end portion of the leash cord is affixed to the harness.

4. The leash system of claim 1 wherein the leash cord includes an elastic cord intermediate the first end portion and the second end portion of the leash cord.

5. The leash system of claim 3 wherein the harness includes a retractable spool, wherein the retractable spool is configured to take up slack in the leash cord.

6. The leash system of claim 1 wherein when the anchoring cord is fixedly secured to the personal watercraft, a distance from the first end portion of the anchoring cord to the loop is greater than a distance from the first end portion of the anchoring cord to the kill switch of the personal watercraft.

7. The leash system of claim 6 wherein a length of the switch cord from its first end portion to its second end portion is less than a difference between a length of the anchoring cord from its first end portion to its second end portion and the distance from the first end portion of the anchoring cord to the kill switch of the personal watercraft.

8. The leash system of claim 1 wherein the leash system is designed such that, while the anchoring cord is fixedly secured to the personal watercraft, a distance from the first end portion of the anchoring cord to the loop is less than a distance from the first end portion of the anchoring cord to the kill switch of the personal watercraft.

9. The leash system of claim 8 wherein a length of the switch cord from its first end portion to its second end portion is less than a length of the anchoring cord from its first end portion to its second end portion subtracted from a sum of the distance from the first end portion of the anchoring cord to the kill switch of the personal watercraft and a distance from the second end portion of the anchoring cord to the loop and a distance from the second end portion of the switch cord to the loop.

10. The leash system of claim 1 wherein when the leash cord is pulled taut, a length between the loop and the kill switch is greater than a length of a portion of the switch cord extending from the loop to the key.

11. The leash system of claim 1 wherein the loop is a ring affixed within the anchoring cord.

12. The leash system of claim 1 wherein anchoring cord is a rope and the loop is an opening formed between strands of the rope.

13. The leash system of claim 1 wherein when the anchoring cord is drawn substantially taut, a portion of the switch cord is drawn through the loop such that the key is drawn adjacent the loop.

14. The leash system of claim 1 wherein the end of the leash includes at least one of a clip and a ring to which the second end of the switch cord and the second end of the anchoring cord are attached.

15. A leash system for use with a personal watercraft, comprising:

a key for connection to a kill switch of the personal watercraft;

a leash cord configured to be affixed at a first end portion to a user of the personal watercraft;

a switch cord having a first end portion affixed to the key and a second end portion affixed to a second end portion of the leash cord;

an anchoring cord having a first end portion affixed to the second end portion of the leash cord, and a second end portion configured to fixedly secure the anchoring cord to the personal watercraft;

a loop affixed along the switch cord slidably receiving the anchoring cord therethrough;

wherein a length of the switch cord is substantially less than a length of the anchoring cord such that, when the leash cord is pulled taut while the anchoring cord is fixedly secured to the personal watercraft, the switch cord removes the key from the kill switch.

16. A leash system for use with a personal watercraft, comprising:

a key for connection to a kill switch of the personal watercraft;

a leash cord configured to be affixed at a first end portion to a user of the personal watercraft;

an inelastic switch cord having a first end portion affixed to the key and a second end portion affixed to a second end portion of the leash cord;

an anchoring cord comprising an elastic portion, the anchoring cord having a first end portion affixed to the second end portion of the leash cord, and a second end portion configured to fixedly secure the anchoring cord to the personal watercraft;

a loop affixed along the anchoring cord slidably receiving the switch cord therethrough;

wherein when the leash cord is pulled taut while the anchoring cord is fixedly secured to the personal watercraft, the first end portion of the switch cord is drawn toward the loop to remove the key from the kill switch.

17. A personal watercraft with a leash system, the personal watercraft comprising:

a board to support a user;

a strut extending from the board;

a hydrofoil wing mounted to the strut; and a leash system comprising:

a leash cord configured to be affixed at a first end portion to a user of the personal watercraft;

a key for connection to a kill switch of the personal watercraft, the key affixed to the leash cord; and a retractable spool mounted in the board, a second end portion of the leash cord wound about a spool of the retractable spool, wherein when the leash cord is pulled away from the retractable spool, the retractable spool dispenses the second end portion of the leash cord from the spool and the key is removed from the kill switch of the personal watercraft causing the personal watercraft to cease operation.

18. The leash system of claim 17 wherein the retractable spool is configured to automatically wind second end portion of the leash cord about the spool to take up slack in the leash cord.

19. The leash system of claim 18 wherein the retractable spool draws the key toward the kill switch of the personal watercraft such that when the second portion of the leash cord is fully wound about the retractable spool the key is attached to the kill switch of the personal watercraft permitting the personal watercraft to operate.

20. A method of using a leash system to disable a personal watercraft when a user of the watercraft falls off the watercraft, the method comprising:

attaching an attachment end of an anchoring cord to an anchor point on the personal watercraft;

securing a key affixed to a key end of a switch cord to a kill switch;

attaching a first end portion of a leash cord to the user, wherein the leash cord includes a second end portion attached to a free end of the anchoring cord, and wherein the second end portion of the leash cord is also affixed to a free end of the switch cord;

pulling the leash cord taut against the anchoring cord, thereby pulling the switch cord and causing the key end of the switch cord to disconnect the key from the kill switch to cause the personal watercraft to cease operation;

wherein the user remains tethered to the personal watercraft when the key is disconnected from the kill switch via the leash cord through its attachment to the anchoring cord and the anchoring cord through its attachment to the personal watercraft, wherein one of the switch cord and the anchoring cord extends through an opening in the other of the anchoring cord and the switch cord, wherein moving the second end portion of the leash more than a predetermined distance draws the key toward the opening.

21. The method of claim 20 wherein the switch cord extends through an opening in the anchoring cord, wherein moving the second end portion of the leash more than a predetermined distance draws the key toward the opening.

22. The method of claim 20 wherein the anchoring cord extends through an opening in the switch cord, wherein moving the second end portion of the leash more than a predetermined distance draws the key toward the opening.

* * * * *